US010881977B1

(12) United States Patent
Wang

(10) Patent No.: US 10,881,977 B1
(45) Date of Patent: Jan. 5, 2021

(54) LEG ASSEMBLY OF A TOY FIGURE

(71) Applicant: EVOLUTIVE LABS CO., LTD., Taipei (TW)

(72) Inventor: Ching-Fu Wang, Taichung (TW)

(73) Assignee: Evolutive Labs Co., LTD., Taipei (TW)

( * ) Notice: Subject to any disclaimer, the term of this patent is extended or adjusted under 35 U.S.C. 154(b) by 0 days.

(21) Appl. No.: 16/567,612

(22) Filed: Sep. 11, 2019

(51) Int. Cl.
*A63H 3/46* (2006.01)
*A63H 33/08* (2006.01)

(52) U.S. Cl.
CPC ..... *A63H 33/086* (2013.01); *A63H 3/46* (2013.01)

(58) Field of Classification Search
CPC ... A63H 3/20; A63H 3/46; A63H 3/50; A63H 33/086; A63H 33/088
See application file for complete search history.

(56) References Cited

U.S. PATENT DOCUMENTS 4,124,952 A * 11/1978 Terzian ..... A63H 3/48 446/183
9,067,147 B1 * 6/2015 Woodhouse ..... A63H 3/16
2015/0314209 A1 * 11/2015 Brooks ..... A63H 3/46 446/128
2015/0314210 A1 * 11/2015 Lama ..... A63H 3/46 446/128
2015/0314211 A1 * 11/2015 Lama ..... A63H 33/062 446/97
2015/0375127 A1 * 12/2015 Fukuchi ..... A63H 3/20 446/321
2017/0014727 A1 * 1/2017 Chen ..... A63H 3/16

FOREIGN PATENT DOCUMENTS

CN 206372526 U 8/2017

OTHER PUBLICATIONS

Search Report appended to an Office Action, which was issued to Taiwanese counterpart application No. 108108035 by the TIPO dated May 14, 2020, with an English translation thereof.

* cited by examiner

*Primary Examiner* — John A Ricci
(74) *Attorney, Agent, or Firm* — Thomas|Horstemeyer, LLP

(57) ABSTRACT

A leg assembly of a toy figure is provided to include a leg unit that includes a thigh component and a shank component. The thigh component has a first leg hole in a rear surface thereof, and a first recess extending from the rear surface in a front-rear direction. The shank component is rotatably connected to the thigh component, and has a second recess extending from a rear surface thereof in the front-rear direction. The leg unit is switchable between an upright state where the first recess and the second recess cooperatively define a second leg hole, and a bent knee state where an angle between the thigh component and the shank component is smaller than that in the upright state.

10 Claims, 6 Drawing Sheets

LEG ASSEMBLY OF A TOY FIGURE

FIELD

The disclosure relates to a leg assembly of a figure, and more particularly to a leg assembly of a LEGO®-type toy figure.

BACKGROUND

LEGO® toys, manufactured by The LEGO Group, have developed a great customer base comprised of people from various age groups, with LEGO® minifigures being the most popular thereamong due to their characteristic designs. However, since the LEGO® minifigures are small and configured with holes on the rear side of their legs for engagement with other LEGO® components, mechanical designs of these legs are simplified without knee joints, resulting in less variations in action poses.

SUMMARY

Therefore, an object of the disclosure is to provide a leg assembly of a LEGO®-type toy figure that offers the toy figure more variations in actions poses.

According to the disclosure, the leg assembly includes a leg unit. The leg unit includes a thigh component and a shank component. The thigh component includes an upper thigh block and a lower thigh block. The upper thigh block has a lateral upper-thigh surface, a rear upper-thigh surface, and a bottom upper-thigh surface having a first recess that extends from the rear upper-thigh surface in a front-rear direction. The upper thigh block is formed with a mounting hole that extends from the lateral upper-thigh surface in a lateral direction transverse to the front-rear direction, and a first leg hole that extends from the rear upper-thigh surface in the front-rear direction. The mounting hole is to be engaged with a hip joint of the LEGO®-type toy figure. The lower thigh block is connected to the bottom upper-thigh surface of the upper thigh block.

The shank component is connected to the lower thigh block in such a way that the thigh component is rotatable in relation to the shank component in the front-rear direction. The shank component includes a rear shank wall having a rear surface, and a top surface that has a second recess extending from the rear surface in the front-rear direction. The leg unit is switchable between an upright state, where the rear upper-thigh surface and the rear surface of the rear shank wall are coplanar and the first recess and the second recess cooperatively define a second leg hole, and a bent knee state, where the thigh component is rotated in relation to the shank component such that an angle formed between the rear upper-thigh surface and the rear surface of the rear shank wall is smaller than that in the upright state.

BRIEF DESCRIPTION OF THE DRAWINGS

Other features and advantages of the disclosure will become apparent in the following detailed description of the embodiment(s) with reference to the accompanying drawings, of which.

DETAILED DESCRIPTION

Figure 1:
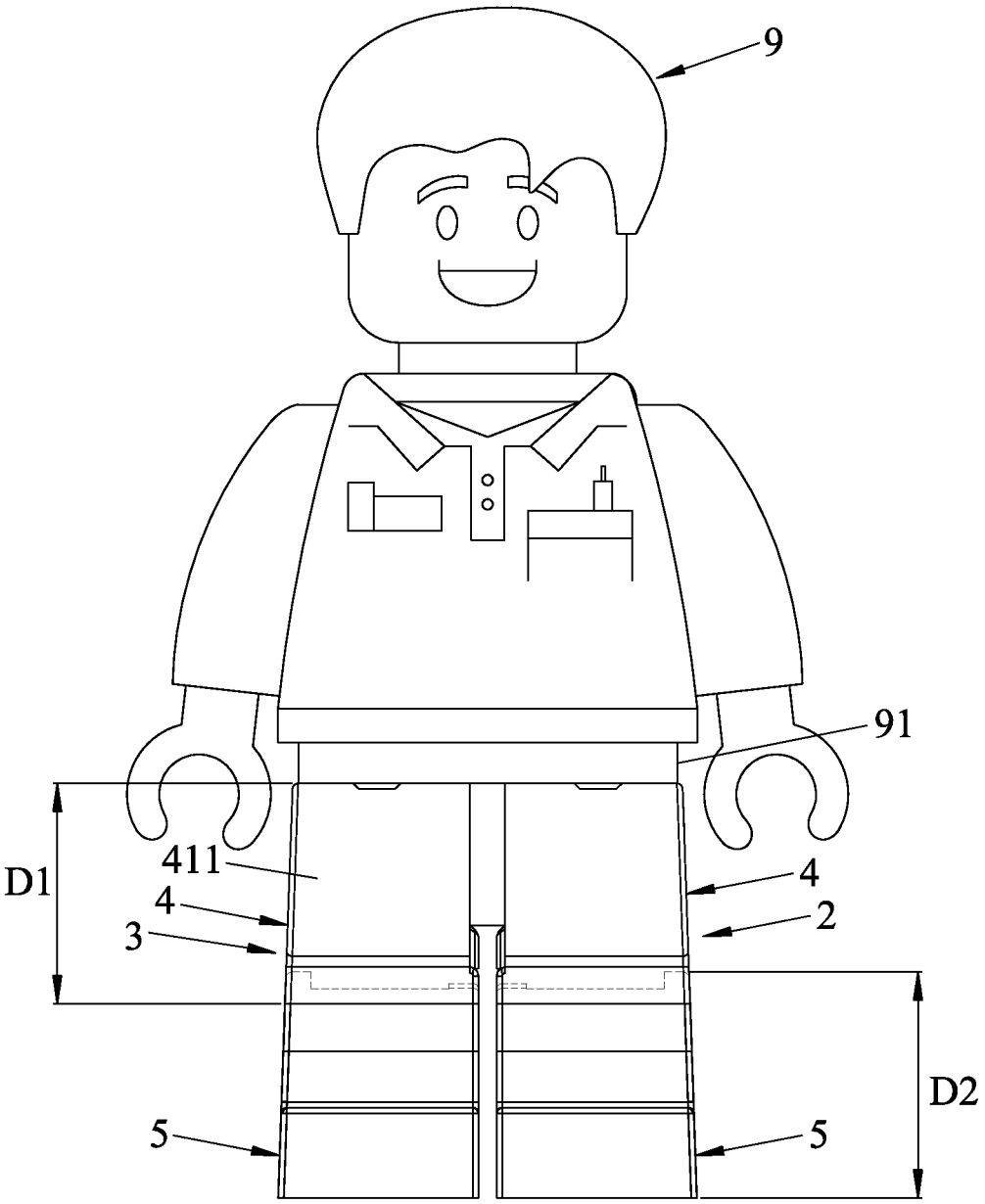
FIG. 1 is a schematic diagram illustrating an embodiment of a leg assembly applied to a LEGO®-type toy figure according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
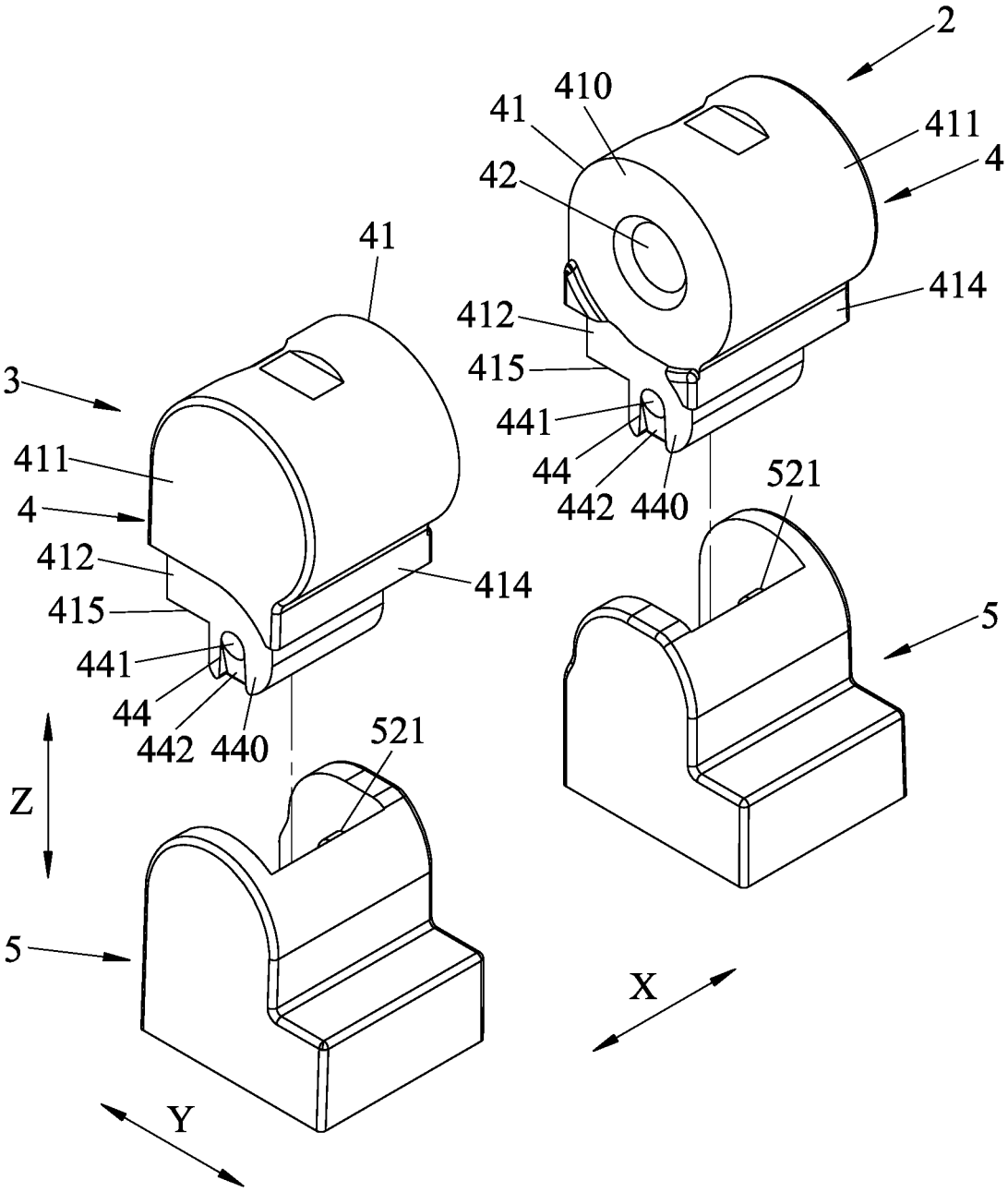
FIG. 2 is a perspective exploded view of the embodiment.
Figure 3:
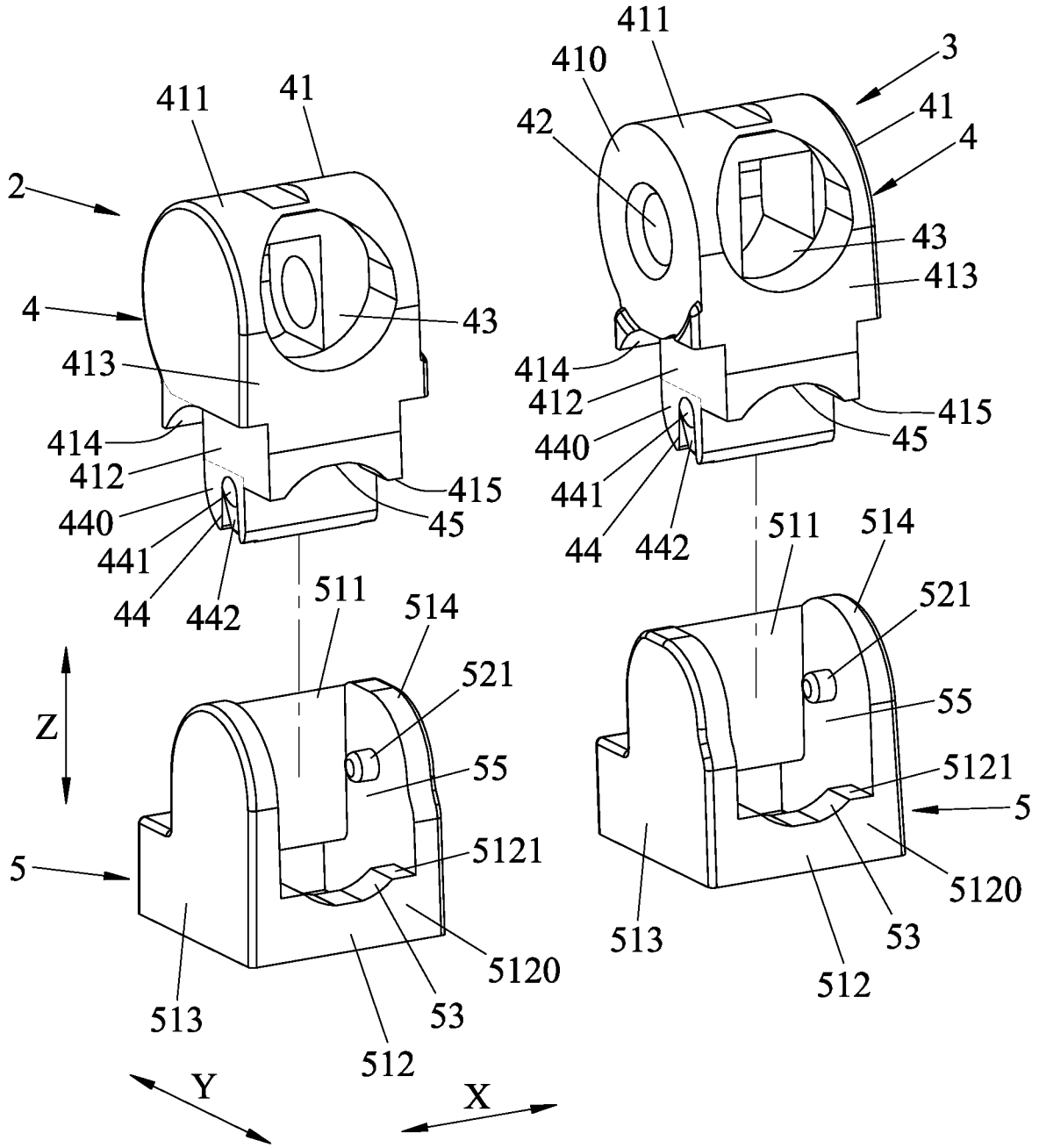
FIG. 3 is a perspective exploded view of the embodiment from another viewing angle.

Referring to FIGS. 1 to 3, an embodiment of a leg assembly of a LEGO®-type toy FIG. 9 is adapted to be mounted to a hip joint 91 of the LEGO®-type toy FIG. 9, and includes two leg units 2, 3 that respectively serve as a left leg and a right leg of the toy FIG. 9. It is noted that directional terms, such as "up", "down", "top", "bottom", "front", "back/rear", "left" and "right", are used with respect to the toy FIG. 9 that stands upright in the following description.

In this embodiment, each of the leg units 2, 3 includes a thigh component 4 and a shank component 5.

The thigh component 4 includes an upper thigh block 41 and a lower thigh block 44. The upper thigh block 41 has a lateral upper-thigh surface 410, a rear upper-thigh surface 413, and a bottom upper-thigh surface 415, and is formed with a mounting hole 42 and a first leg hole 43. The mounting hole 42 extends from the lateral upper-thigh surface 410 in a lateral direction (X) and is pivotally engaged with a shaft (not shown) of the hip joint 91, so that the thigh component 4 is pivotally connected to the hip joint 91 of the LEGO®-type toy FIG. 9. The first leg hole 43 extends from the rear upper-thigh surface 413 in a front-rear direction (Y) transverse to the lateral direction (X). The bottom upper-thigh surface 415 has a first recess 45 that extends from the rear upper-thigh surface 413 in the front-rear direction (Y).

The upper thigh block 41 includes an upper portion 411, and a lower portion 412 that is narrower than the upper portion 411 in the lateral direction (X). In this embodiment, the lower portion 412 of the upper thigh block 41 has the same width as the lower thigh block 44 in the lateral direction (X), but this disclosure is not limited in this respect.

The lower thigh block 44 is connected to the bottom upper-thigh surface 415 of the upper thigh block 41, and has two lateral surfaces 440 opposite to each other in the lateral direction (X). Each of the lateral surfaces 440 has a pivot hole 441, and a guiding groove 442 that is in spatial communication with the pivot hole 441 and that extends from a bottom edge of the lateral surface 440 toward the pivot hole 441. In this embodiment, for each of the lateral surfaces 440, the guiding groove 442 has a depth that gradually reduces from the bottom edge of the lateral surface 440 to the pivot hole 441, and a smallest depth of the guiding groove 442 is smaller than a depth of the pivot hole 441.

Figure 4:
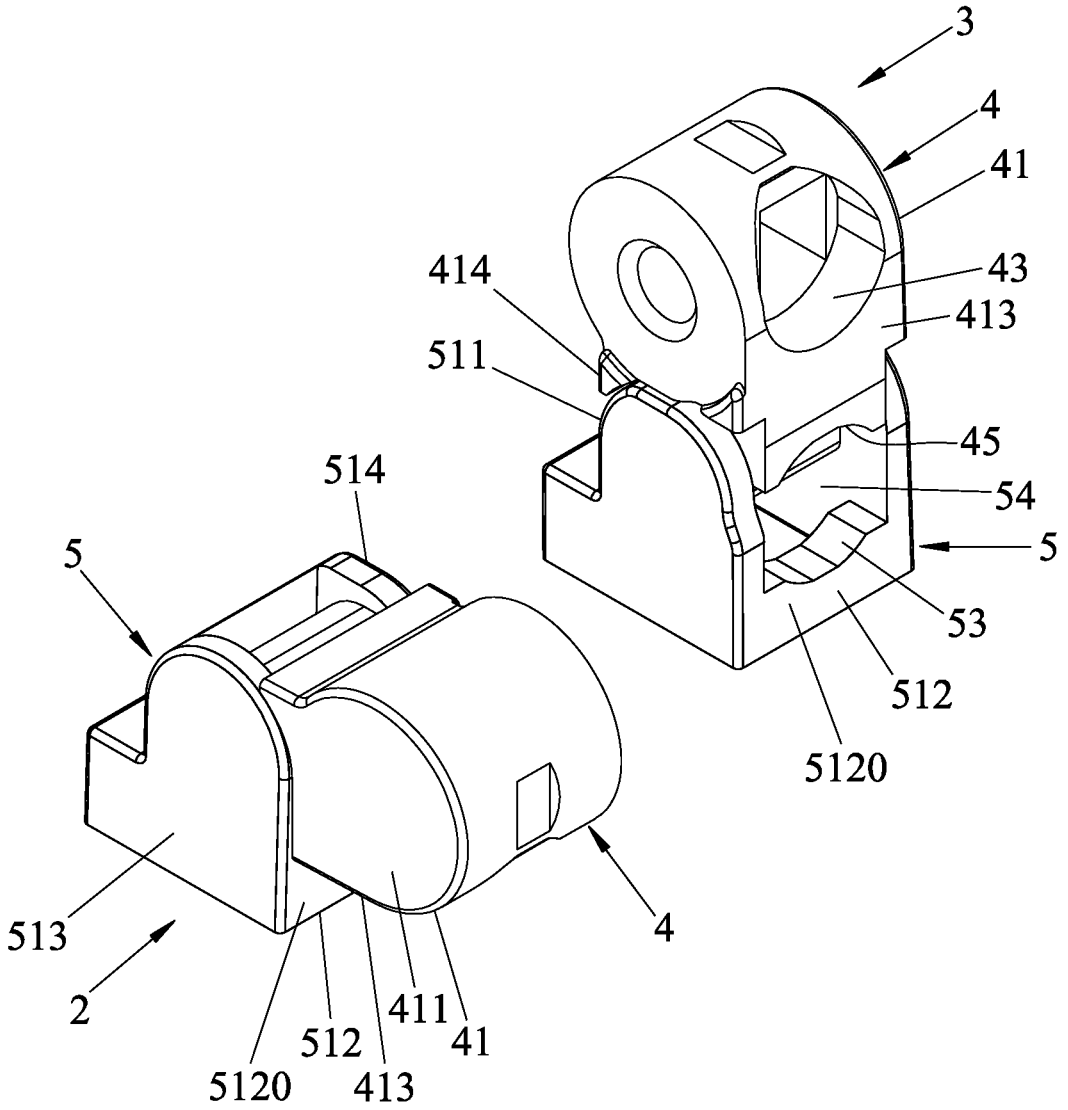
FIG. 4 is a perspective view of the embodiment, illustrating a leg unit in an upright state and another leg unit in a bent knee state.

The shank component 5 is connected to the lower thigh block 44 in such a way that the thigh component 4 is rotatable in relation to the shank component 5 in the front-rear direction (Y), so that each of the leg units 2, 3 is switchable between an upright state (e.g., the leg unit 3 in FIG. 4) and a bent knee state (e.g., the leg unit 2 in FIG. 4).

The shank component 5 includes a front shank wall 511, a rear shank wall 512 opposite to the front shank wall 511 in the front-rear direction (Y), and two lateral shank walls 513, 514 opposite to each other in the lateral direction (X) and each connected between the front shank wall 511 and the rear shank wall 512. The front shank wall 511, the rear shank wall 512 and the lateral shank walls 513, 514 cooperatively define a mounting space 55 in which the lower portion 412 of the upper thigh block 41 and the lower thigh block 44 are inserted together. The rear shank wall 512 is shorter than the front shank wall 511 and the lateral shank walls 513, 514 in an up-down direction (Z) transverse to the lateral direction (X) and the front-rear direction (Y), and has a rear surface 5120 and a top surface 5121. The top surface 5121 has a second recess 53 extending from the rear surface 5120 in the front-rear direction (Y).

Referring to FIG. 4, the leg unit 3 is in the upright state, where the thigh component 4 is rotated forwardly in relation to the shank component 5 such that the rear upper-thigh surface 413 of the upper thigh block 41 and the rear surface 5120 of the rear shank wall 512 are coplanar, a lower-front edge of the upper thigh block 41 is proximate to the front shank wall 511, and the first recess 45 and the second recess 53 cooperatively define a second leg hole 54.

Figure 5:
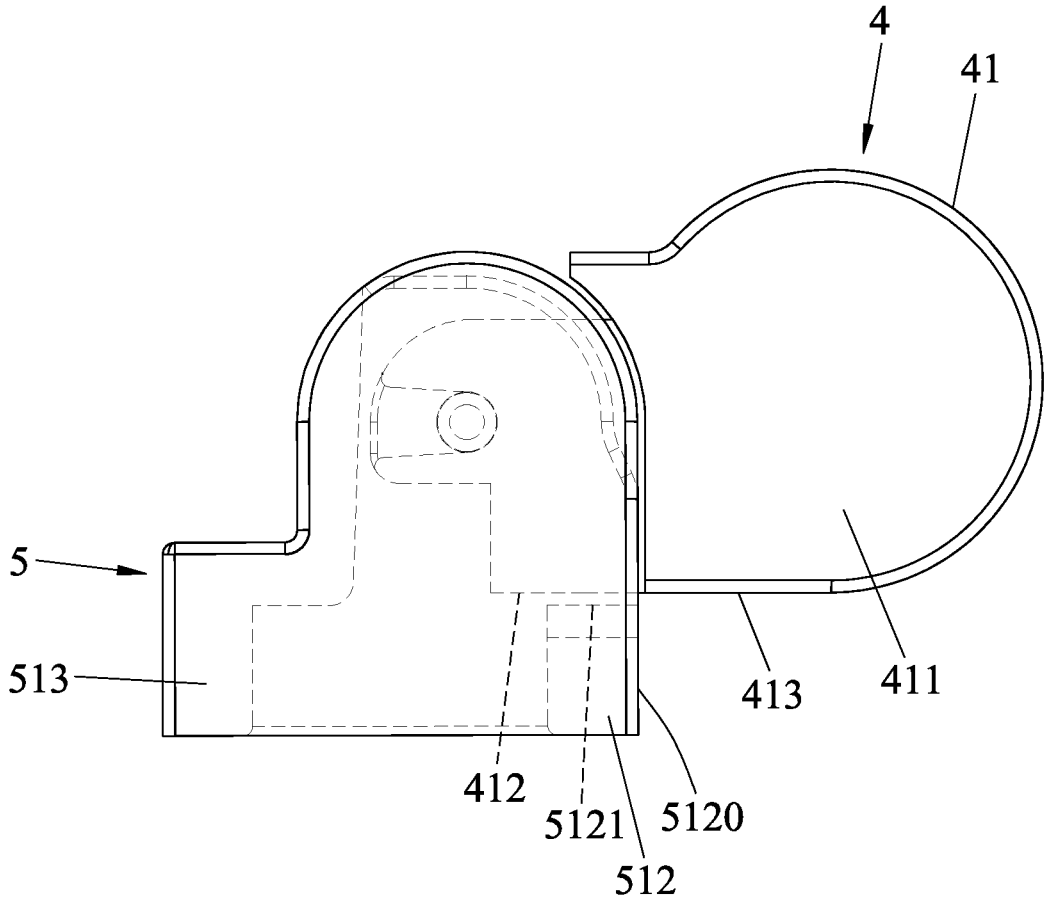
FIG. 5 is a side view illustrating the leg unit of the embodiment in the bent knee state.

Referring to FIGS. 4 and 5, the leg unit 2 is in the bent knee state, where the thigh component 4 is rotated backwardly in relation to the shank component 5 such that an angle formed between the rear upper-thigh surface 413 of the upper thigh block 41 and the rear surface 5120 of the rear shank wall 512 (referred to as knee angle hereinafter) is smaller than that in the upright state. When the thigh component 4 is rotated backwardly to a completely bent knee position (i.e., the leg unit 2, 3 is in the bent knee state), a bottom surface of the upper portion 411 of the upper thigh block 41 is proximate to rear edges of the lateral shank walls 513, 514, and the lower portion 412 of the upper thigh block 41 is proximate to the top surface 5121 of the rear shank wall 512. In practice, the rear edges of the lateral shank walls 513, 514 may be designed to have a curvature fitting that of the bottom surface of the upper portion 411 of the upper thigh block 41, and the knee angle at the completely bent knee position can be determined based on a height of the rear shank wall 512 in the up-down direction (Z). In this embodiment, the knee angle at the completely bent knee position is designed to be 90 degrees, and the knee angle can vary between 90 degrees and 180 degrees (i.e., the knee angle in the upright state), but this disclosure is not limited in this respect.

In this embodiment, a ratio of a vertical length of the upper portion 411 of the upper thigh block 41 (see D1 in FIG. 1) in the up-down direction (Z) to a vertical length of the shank component 5 (see D2 in FIG. 1) in the up-down direction (Z) is between 0.9 and 1.1 when the leg unit 2, 3 is in the upright state. In some embodiments, the ratio of D1 to D2 ranges between 0.97 and 0.99. In some embodiments, D1 and D2 are designed to be 7.82 mm and 7.99 mm, respectively, so as to obtain an optimal visual proportion in both the upright state and the bent knee state.

Referring to FIGS. 3 and 4, in this embodiment, when viewed from the back, the first leg hole 43 is circular and has a diameter of 4.88 mm. Further, when the leg unit 3 in the upright state and is viewed from the back, the first recess 45 and the second recess 53, which cooperatively define the second leg hole 54, are two arcs of an imaginary circle having a diameter of 4.88 mm. In the upright state, a bottom edge of the first leg hole 43 is spaced apart from a top edge of the second leg hole 54 by 3.15 mm. By such configuration, the dimensions of the first and second leg holes 43, 54 are compatible with LEGO®-type accessories and the dimensions of studs of LEGO®-type bricks, so the leg units 2, 0.3 are able to be assembled with other LEGO®-type components.

In this embodiment, the lateral shank walls 513, 514 of the shank component 5 of each of the leg units 2, 3 have different heights in the up-down direction (Z); i.e., the upper edges of the lateral shank walls 513, 514 are not aligned while the bottom edges of the lateral shank walls 513, 514 are aligned. Furthermore, the shank components 5 of the leg units 2, 3 are mirrored (i.e., in bilateral symmetry). In this embodiment, the lateral shank wall that corresponds to an outer side of the shank component 5 (i.e., the lateral shank wall 513 for the leg unit 2 and the lateral shank wall 514 for the leg unit 3) is taller than the lateral shank wall that corresponds to an inner side of the shank component 5 (i.e., the lateral shank wall 514 for the leg unit 2 and the lateral shank wall 513 for the leg unit 3). Such a mistake-proofing design may prevent inadvertent errors in assembly of the leg unit 2, 3, but this disclosure is not limited in this respect. In this embodiment, the upper thigh block 41 further has a cover part 414 that extends downwardly from a front side of the bottom surface of the upper portion 411 of the upper thigh block 41 in order to conceal the height difference between the lateral shank walls 513, 514, so a visual border between the thigh component 4 and the shank component 5 would be a straight line (see FIG. 1), achieving a better outlook of the leg assembly.

Referring to FIGS. 2 and 3, the shank component 5 further includes two protrusions 521 that are connected respectively to the lateral shank walls 513, 514 and that rotatably extend into the pivot holes 441, respectively, but this disclosure is not limited in this respect. In other embodiments, the lower thigh block 44 may include protrusions respectively extending from the lateral surfaces 440, and each of the lateral shank walls 513, 514 may include a pivot hole for extension of a respective one of the protrusions of the lower thigh block 44 thereinto.

During assembly, a player may be aware of whether the thigh component 4 and/or the shank component 5 corresponds to a right leg or a left leg of the toy FIG. 9 (see FIG. 1) based on the position of the mounting hole 42 and the abovementioned mistake-proofing design (i.e., different heights of the lateral shank walls 513, 514).

Then, the player may assemble the thigh components 4 of the leg units 2, 3 on the hip joint 91 of the toy FIG. 9 by engaging the mounting holes 42 with the shaft of the hip joint 91 and inserting the protrusions 521 respectively into the pivot holes 441 via the guiding grooves 442.

After the assembly, a height of the each of the leg units 2, 3 and a ratio between the heights of the leg portion and the entire toy FIG. 9 are the same as those of LEGO® minifigures, so the LEGO® or LEGO®-type components can be used on the toy FIG. 9 that have the leg units 2, 3.

Figure 6:
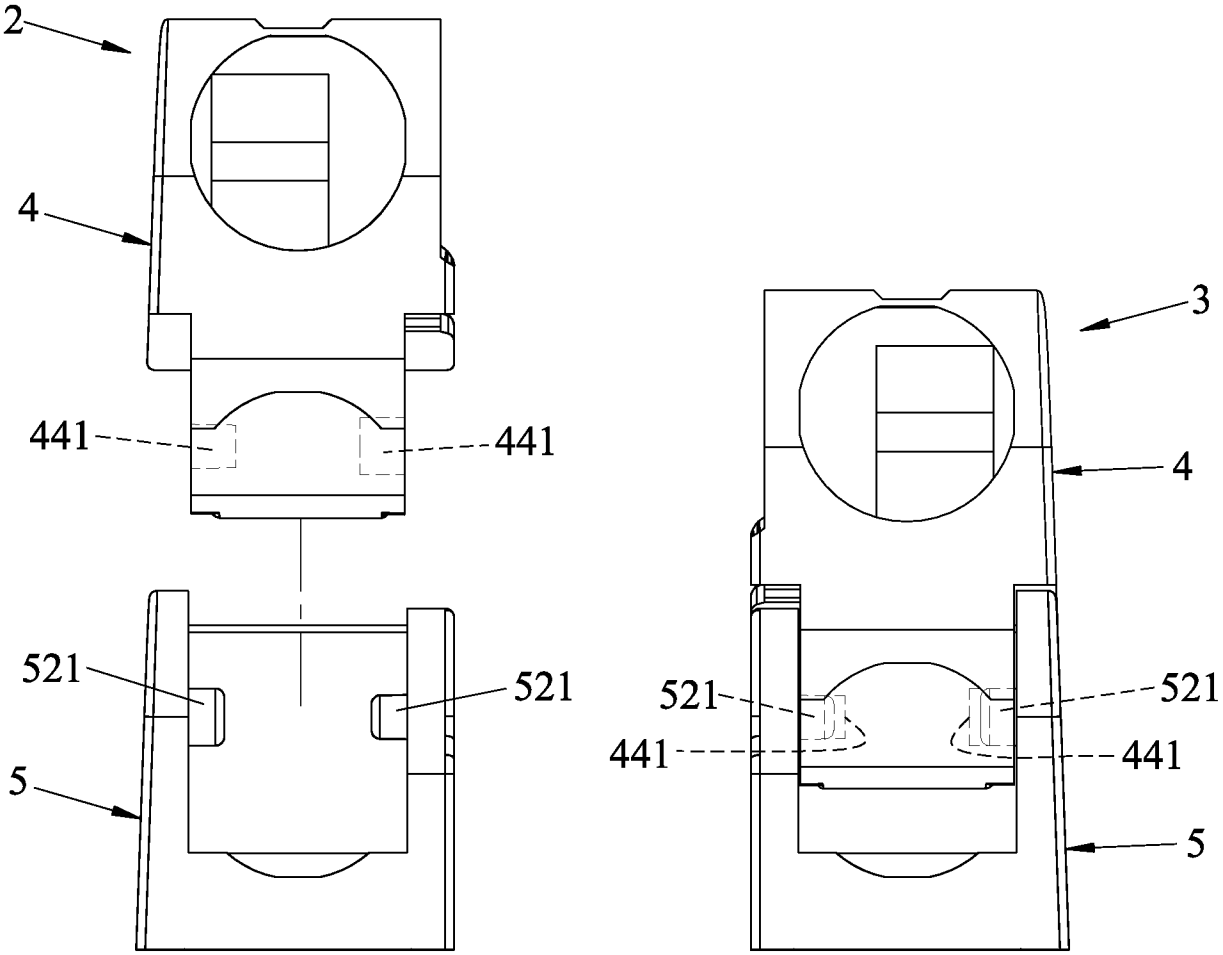
FIG. 6 is a schematic diagram illustrating a rear view of another implementation of the embodiment.

FIG. 6 shows another implementation of the leg units 2, 3. In this implementation, for each of the leg units 2, 3, the protrusions 521 are different in size (e.g., in length and/or in diameter). In FIG. 6, the protrusion 521 at the left side has a diameter greater than that of the protrusion 521 at the right side for the shank component 5 corresponding to the left leg (i.e., the leg unit 2), and the protrusion 521 at the right side has a diameter greater than that of the protrusion 521 at the left side for the shank component 5 corresponding to the right leg (i.e., the leg unit 3). Correspondingly, for each of the leg units 2, 3, the pivot holes 441 have different internal sizes matching the protrusions 521, respectively. In FIG. 6, the pivot hole 441 at the left side has an inner diameter greater than that of the pivot hole 441 at the right side for the thigh component 4 corresponding to the left leg (i.e., the leg unit 2), and the pivot hole 441 at the right side has an inner diameter greater than that of the pivot hole 441 at the left side for the thigh component 4 corresponding to the right leg (i.e., the leg unit 3).

It is noted that the two leg units 2, 3 are mirrored to achieve symmetric visual perception in this disclosure, but this disclosure is not limited to such. In some embodiments, the two leg units 2, 3 may be designed asymmetric for some special characters.

The embodiment of the leg assembly according to this disclosure has the following advantages:

1. By configuring the leg unit 2, 3 to have the thigh component 4 and the shank component 5 that are separably and rotatably connected to each other, the leg portion of the toy FIG. 9 is granted higher degrees of freedom, thus giving the player more options with poses of the toy FIG. 9. In addition, with inclusion of the first and second leg holes 43, 54, the toy FIG. 9 is operable to be assembled with other LEGO®-type components, thereby increasing even more options to play with the toy FIG. 9.

2. The depth of the guiding groove 442 gradually reduces from the edge to the pivot hole 441, making assembly of the leg unit 2, 3 easier. In addition, since the smallest depth of the guiding groove 442 is smaller than that of the pivot hole 441, the corresponding protrusion 521 may be firmly engaged with the pivot hole 441 after sliding into the pivot hole 441 along the guiding groove 442.

3. Better visual proportion may be achieved by configuring the ratio of the vertical length (D1) of the upper portion 411 of the upper thigh block 41 to the vertical length (D2) of the shank component 5 to be between 0.9 and 1.1.

4. Different heights of the lateral shank walls 513, 514 and different sizes of the protrusions 521 and corresponding pivot holes 441 may aid the player in identifying whether the shank component 5 corresponds to the left leg or the right leg of the toy FIG. 9.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A leg assembly of a toy figure that includes a hip joint, comprising:

a leg unit that includes:

a thigh component including:

an upper thigh block having a lateral upper-thigh surface, a rear upper-thigh surface, and a bottom upper-thigh surface having a first recess that extends from said rear upper-thigh surface in a front-rear direction, said upper thigh block being formed with a mounting hole that extends from said lateral upper-thigh surface in a lateral direction transverse to the front-rear direction, and a first leg hole that extends from said rear upper-thigh surface in the front-rear direction, said mounting hole to be engaged with the hip joint of the toy figure; and a lower thigh block connected to said bottom upper-thigh surface of said upper thigh block; and a shank component connected to said lower thigh block in such a way that said thigh component is rotatable in relation to said shank component in the front-rear direction, said shank component including a rear shank wall having a rear surface, and a top surface that has a second recess extending from said rear surface in the front-rear direction;

wherein said leg unit is switchable between an upright state where said rear upper-thigh surface and said rear surface of said rear shank wall are coplanar and said first recess and said second recess cooperatively define a second leg hole, and a bent knee state where said thigh component is rotated in relation to said shank component such that an angle formed between said rear upper-thigh surface and said rear surface of said rear shank wall is smaller than that in the upright state.

2. The leg assembly of claim 1, wherein said shank component further includes a front shank wall opposite to said rear shank wall, and two lateral shank walls opposite to each other and each connected between said front shank wall and said rear shank wall, and said front shank wall and said lateral shank walls are taller than said rear shank wall in an up-down direction transverse to the lateral direction and the front-rear direction and cooperate with said rear shank wall to define a mounting space in which said lower thigh block is inserted.

3. The leg assembly of claim 2, wherein said upper thigh block includes:

an upper portion that is formed with said mounting hole and said first leg hole and that is wider than said lower thigh block in the lateral direction; and a lower portion that is formed with said first recess, and that is inserted into said mounting space together with said lower thigh block.

4. The leg assembly of claim 3, wherein a ratio of a vertical length of said upper portion of said upper thigh block in the up-down direction to a vertical length of said shank component in the up-down direction is between 0.9 and 1.1 when said leg unit is in the upright state.

5. The leg assembly of claim 3, wherein said thigh component is rotated backwardly in relation to said shank component to a position where said lower portion of said upper thigh block is proximate to said top surface of said rear shank wall when said leg unit is in the bent knee state.

6. The leg assembly of claim 2, wherein said lower thigh block has two lateral surfaces, each of which has a pivot hole, and a guiding groove that is in spatial communication with said pivot hole and that extends from a bottom edge of said lateral surface toward said pivot hole;

wherein, for each of said lateral surfaces, said guiding groove has a depth that gradually reduces from said bottom edge of said lateral surface to said pivot hole, and a smallest depth of said guiding groove is smaller than a depth of said pivot hole; and wherein said shank component further includes two protrusions that are connected respectively to said lateral shank walls and that respectively extend into said pivot holes.

7. The leg assembly of claim 6, comprising two of said leg units to serve as a left leg and a right leg of the toy figure, respectively.

8. The leg assembly of claim 7, wherein, for each of said leg units, said protrusions of said shank component are different in size, and said pivot holes have different internal sizes matching said protrusions, respectively.

9. The leg assembly of claim 8, wherein said shank components of said leg units are mirrored.

10. The leg assembly of claim 7, wherein, for each of said leg units, said lateral shank walls have different heights in the up-down direction, and said shank components of said leg units are mirrored.

* * * * *